US008146649B2

(12) United States Patent
Miyake et al.

(10) Patent No.: US 8,146,649 B2
(45) Date of Patent: Apr. 3, 2012

(54) METHOD OF CONTINUOUS CASTING OF HIGH-ALUMINUM STEEL AND MOLD POWDER

(75) Inventors: Takashi Miyake, Kakogawa (JP); Hitoshi Nakata, Kakogawa (JP); Tsuyoshi Mimura, Kakogawa (JP); Tomoaki Omoto, Chiyoda-ku (JP); Yukimasa Iwamoto, Chiyoda-ku (JP)

(73) Assignee: Kobe Steel, Ltd., Kobe-shi (JP)

( * ) Notice: Subject to any disclaimer, the term of this patent is extended or adjusted under 35 U.S.C. 154(b) by 685 days.

(21) Appl. No.: 12/297,984

(22) PCT Filed: Apr. 23, 2007

(86) PCT No.: PCT/JP2007/058751

§ 371 (c)(1),
(2), (4) Date: Nov. 4, 2008

(87) PCT Pub. No.: WO2007/125871

PCT Pub. Date: Aug. 11, 2007

(65) Prior Publication Data

US 2011/0094703 A1 Apr. 28, 2011

(30) Foreign Application Priority Data

Apr. 25, 2006 (JP) ..... 2006-120786
Apr. 25, 2006 (JP) ..... 2006-121055

(51) Int. Cl.
*B22D 27/02* (2006.01)
*B22D 11/04* (2006.01)

(52) U.S. Cl. ..... 164/468; 164/478

(58) Field of Classification Search ..... 164/468, 164/478

See application file for complete search history.

(56) References Cited

U.S. PATENT DOCUMENTS 7,493,936 B2 * 2/2009 Nakata et al. ..... 164/472
7,967,058 B2 * 6/2011 Kubota et al. ..... 164/502
2001/0004932 A1 * 6/2001 Nakata et al. ..... 164/466
2005/0045303 A1 * 3/2005 Itoyama et al. ..... 164/453

FOREIGN PATENT DOCUMENTS

| | | |
|---|---|---|
| JP | 10-216907 | 8/1998 |
| JP | 2002 346708 | 12/2002 |
| JP | 2002-346708 | 12/2002 |
| JP | 2003-53496 | 2/2003 |
| JP | 2003 181606 | 7/2003 |
| JP | 2003-181606 | 7/2003 |

OTHER PUBLICATIONS

Office Action issued Sep. 5, 2010, in Korean Patent Application No. 10-2008-7026242 (with English language translation).

Taira Okamoto et al., "Influence of alloy elements on temperature and composition of Peritectic Reaction in Carbon Steel", The Institute of Science and Industrial Research, Solidification-373, Oct. 23, 1985, 28 pages, (with English abstract).

Japanese Office Action issued Aug. 31. 2010, in Japanese Patent Application No. 2006-120786 (with English-language translation).

* cited by examiner

*Primary Examiner* — Kevin P Kerns
(74) *Attorney, Agent, or Firm* — Oblon, Spivak, McClelland, Maier & Neustadt, L.L.P.

(57) ABSTRACT

A method of continuously casting molten steel to produce high surface quality slab by preventing depressions and cracking. The steel is high Al steel having an Al content of 0.1% or more. High-Al molten steel is continuously cast using mold powder containing T—CaO (T—CaO presumes total Ca converted to CaO): 35 to 55%, $SiO_2$: 10 to 30%, $Al_2O_3$: 4.0% or less (excluding 0%), MgO: 0.2 to 1.0%, $Li_2O$: 7 to 13%, F: 7 to 13%, C: 10.5 to 14%, and inevitable impurities; and satisfying: $1.6 \leqq [T—CaO]/[SiO_2] \leqq 5$ and $0.2 \leqq [Li_2O]/[SiO_2] \leqq 1.1$. The method is performed by controlling the molten steel surface level fluctuation speed in the mold; the pouring angle of the molten steel in the width direction of the mold; the stroke in the amplitude; and the negative strip time tN as defined.

2 Claims, No Drawings

METHOD OF CONTINUOUS CASTING OF HIGH-ALUMINUM STEEL AND MOLD POWDER

FIELD OF THE INVENTION

The invention relates to a method of producing a high-aluminum steel by continuous casting from a molten steel containing 0.1% by mass or more of dissolved aluminum (Al) and particularly to a method of continuous casting of a slab with good surface quality.

BACKGROUND ART

In a method of continuous casting of a steel, a mold powder is added to the molten steel surface in a mold. The powder melts and becomes slag by heat from the molten steel and forms a molten slag layer and flows successively into a gap between the mold and a solidified shell and is thus consumed. The mold powder mainly contains CaO and $SiO_2$ and is also mixed with $Al_2O_3$, MgO, $Na_2O$, F, or $Li_2O$ in order to adjust the viscosity of the molten slag and the solidification temperature as well as with C in order to adjust the melting speed of the slag. The mold powder has main roles of (A) reliably retaining the lubricating property between the mold and the solidified shell and (B) carrying out moderate cooling by suppressing the heat extraction speed from the solidified shell to the mold.

First, in order to reliably retain the lubricating property between the mold and the solidified shell described in (A), it is important to properly set the viscosity and the solidification temperature in order to ensure the proper flow amount of the molten slag obtained from the mold powder into the gap between the casting mold and the solidified shell. Generally, those with low viscosities are used as the casting speed is higher to assure the flow amount of the molten slag.

The moderate cooling described in (B) is important since it directly affects the surface quality of a slab to be obtained. In the case of steel types such as a hypo-peritectic steel that are easy to cause slab surface cracking, moderate cooling is particularly required. For moderate cooling, it is effective to crystallize crystals in a slag film obtained from the mold powder, particularly on the surface in the mold side. It is because if crystals are crystallized on the surface in the mold side, projections and recessions are formed between the film and the mold and the air layer contained in the projections and recessions works as a heat insulating layer. As the crystals, cuspidine ($3CaO\text{-}2SiO_2$—$CaF_2$) is generally used.

However, in the case of producing a slab from a molten steel having a dissolved Al amount of 0.1% or more by a continuous casting method, it becomes difficult to (A) reliably retain the lubricating property and (B) carry out moderate cooling. Because, in the continuous casting of such a high Al steel, $SiO_2$ is consumed by chemical reaction expressed by the following reaction formula (7):

$$4Al+3SiO_2 \rightarrow 2Al_2O_3+3Si \quad (7)$$

Therefore, the basicity $[CaO]/[SiO_2]$ in the molten slag is increased and the solidification temperature is considerably increased. Subsequently, a hard sintered substance so-called slag bear is formed in the wall face of the mold to inhibit the flow of the molten slag. As a result, the lubricating property is deteriorated and the solidified shell may stick to the mold to cause breakout.

Further, since the composition fluctuation of the molten slag occurs because of the reaction defined by the above-mentioned formula (7), it becomes difficult to stably produce cuspidine. As described above, in the continuous casting of a high-Al steel, since the composition fluctuation occurs because of the reaction defined by the formula (7), it becomes difficult to stably produce a slab with excellent surface quality.

Therefore, Patent Document 1 proposes a mold powder having a low basicity and a high viscosity as well as a composition and a physical property hard to crystallize to produce a slab excellent in the surface quality even by continuous casting of a high-Al steel, particularly to suppress formation of slag bear (Claims and the paragraphs [0004] to [0007]).

Further, Patent Document 2 discloses a mold powder containing two or more oxides of Group IA elements in the periodic table to produce compounded crystals different from cuspidine and accomplish moderate cooling (Claims and the paragraph [0013]). In this connection, in the invention disclosed in Patent Document 2, $LiCa_2FSiO_4$ and $NaCa_2FSiO_4$ are disclosed as assumed compounded crystals, and it is supposed that $NaCa_2FSiO_4$ is assumed as a main compounded crystal since its $Na_2O$ amount is highest among oxides of the Group IA elements in the periodic table used in Examples (the paragraphs [0020] and [0030]). The invention of Patent Document 2 aims to lower the softening temperature of the mold powder and is characterized in that two or more oxides of Group IA elements in the periodic table are contained (the paragraph [0024]).

Patent Document 3 proposes a mold powder having a composition satisfying a prescribed expression of contents of CaO, $SiO_2$, $Li_2O$, F, $Na_2O$, $K_2O$, and $Al_2O_3$ and crystallizing cuspidine in a film formed by solidifying a molten layer in order to prevent occurrence of breakout and deterioration of the surface quality of a slab due to increase in solidification temperature and viscosity (Claims and the paragraphs [0011] and [0017]).

However, even in the case of a high-Al steel, particularly a steel having a composition in a range where the peritectic reaction or $\delta/\gamma$ transformation amount is high, even if the above-mentioned mold powder is used, there is a problem that depressions (projections and recessions) and cracking following the transformation shrinkage tend to be caused in the surface of a slab to be obtained. Such a kind of steel is called a hypo-peritectic steel and generally, the chemical component composition range is determined on the basis of the C content [C] in accordance with a binary system equilibrium phase diagram of Fe—C or Fe—$Fe_2C_3$. The range is said to be approximately C: 0.09 to 0.18%.

However, in the case of an alloy steel, since the phase diagram itself is changed due to the effect of added elements and both of the maximum solid solution C concentration in a $\delta$ phase and the peritectic point are shifted, the composition range of the hypo-peritectic steel cannot definitely be standardized on the basis of solely the C content. Accordingly, regarding the high Al steels, particularly a steel having a composition in which the peritectic reaction or the $\delta/\gamma$-transformation amount is high, it is known to standardize the following as defined by the expressions (1) to (3) by equilibrium thermodynamics calculation in consideration of the effects of alloying elements such as Si, Mn, Al, Ni, Cr and Mo (Non-Patent Document 1). In addition, with respect to a hypo-peritectic steel to which the following expressions are applied, the contents of the basic components, Si, Mn, Al, Ni, Cr and Mo, are assumed to 4.0% or less (excluding 0%) each and the content of Al is 0.1 to 3.0%.

$$f1-0.10 \leqq [C] \leqq f2+0.05 \quad (1);$$

$$f1=0.0828[Si]-0.0195[Mn]+0.07398[Al]-0.04614[Ni]+0.02447[Cr]+0.01851[Mo]+0.090 \quad (2); \text{ and}$$

$$f2=0.2187[Si]-0.03291[Mn]+0.2017[Al]-0.06715[Ni]+0.04776[Cr]+0.04601[Mo]+0.173 \quad (3)$$

(In the expressions, [Si], [Mn], [Al], [Ni], [Cr], and [Mo] denote respective contents (% by mass) of Si, Mn, Ni, Cr, and Mo).

Patent Document 1: Japanese Patent Application Laid-Open (JP-A) No. 2003-53496 (Claims and the paragraphs [0004] and [0007])

Patent Document 2: JP-A No. 10-216907 (Claims and the paragraphs [0013], [0020], [0024], and [0030])

Patent Document 3: JP-A No. 2002-346708 (Claims and the paragraphs [0011] and [0017])

Non-Patent Document 1: "Solidification"-373 (1985), Solidification Phenomenon Conference 10670, third session, 19th Steelmaking Committee, Japan Society for the Promotion of Science

DISCLOSURE OF THE INVENTION

Problems to be Solved by the Invention

It is important to lower the heat extraction speed and carry out moderate cooling in order to suppress cracking in the case of a steel type which is easy to cause slab surface cracking such as a hypo-peritectic steel defined by the above-mentioned expressions (1) to (3). Therefore, in general, cuspidine ($3CaO\text{-}2SiO_2$—$CaF_2$) is conventionally crystallized in the slag film formed from a mold powder to form projections and recessions (a heat insulating layer by air) in the mold surface and thus moderate cooling is achieved. However, in the case of a high Al steel, it is difficult to stably produce cuspidine due to composition fluctuation.

Further, to produce the above-mentioned steel types while maintaining the good surface quality, it is of course important to use a proper mold powder and it is also required to properly control the condition of continuous casting. However, in the case of continuous casting of a high Al steel having an Al content of 0.1% or more, presently, it may be said that the optimum casting condition has not yet been established.

In view of the above state of the art, the invention has been made aiming to provide a method of continuous casting for producing a slab excellent in surface quality by preventing formation of depressions and occurrence of cracking of the slab even in the case of producing a high Al steel having an Al content of 0.1% or more by continuous casting and also to provide a mold powder.

Means for Solving the Problems

A continuous casting method of a first aspect of the invention is a method of continuous casting of a molten steel containing 0.1 to 3.0% (% by mass, hereinafter the same) of Al and also each 4.0% or less (excluding 0%) of Si, Mn, Ni, Cr, and Mo and C in a content [C] satisfying relations defined by the following expressions (1) to (3):

$$f1-0.10 \leqq [C] \leqq f2+0.05 \quad (1);$$

$$f=0.0828[Si]-0.0195[Mn]+0.07398[Al]-0.04614[Ni]+0.02447[Cr]+0.01851[C]+0.090 \quad (2); \text{ and}$$

$$f2=0.2187[Si]-0.03291[Mn]+0.2017[Al]-0.06715[Ni]+0.04776[Cr]+0.04601[Mo]+0.173 \quad (3)$$

wherein [Si], [Mn], [Al], [Ni], [Cr], and [Mo] denote respective contents (% by mass) of Si, Mn, Ni, Cr, and Mo) by using a mold powder, wherein the mold powder contains T—CaO: 35 to 55%, $SiO_2$: 10 to 30%, $Al_2O_3$: 4.0% or less (excluding 0%), MgO: 0.2 to 1.0%, $Li_2O$: 7 to 13%, F: 7 to 13%, C, 10.5 to 14%, and inevitable impurities and satisfies the following expressions (4) and (5):

$$1.6[T\text{—}CaO]/[SiO_2] \leqq 5 \quad (4); \text{ and}$$

$$0.2 \leqq [Li_2O]/[SiO_2] \leqq 1.1 \quad (5)$$

wherein [T—CaO], [$SiO_2$], and [$Li_2O$] denote respective contents (% by mass) of T—CaO, $SiO_2$, and $Li_2O$ in the mold powder; and the method is carried out by adjusting the molten steel surface level fluctuation speed in the mold to be 14 mm/second or lower; pouring the molten steel in the width direction of the mold by using an immersion nozzle at a pouring angle of 0° or more and 55' or less downward from the horizontal direction while applying mold oscillation in the condition of the stroke in the amplitude of beyond 2 mm and 8 mm or less and the negative strip time tN defined by the following expression (6) of 0.28 seconds or shorter:

$$tN=(1/\pi \cdot f)\cos^{-1}(Vc/\pi \cdot f \cdot s) \quad (6)$$

wherein f denotes the mold oscillation frequency (Hz); s denotes the distance (mm) between the upper dead point and the lower dead point of the mold at the time of mold oscillation; and Vc denotes the casting velocity (mm/s) of a slab.

In the above-mentioned method of the invention, the method is preferably carried out while electromagnetic stirring is carried out in the mold at a magnetic flux density of 300 to 1200 gauss.

A mold powder of a second aspect of the invention is a mold powder for continuous casting of a steel containing 0.1% or more of dissolved Al, wherein the mold powder contains T—CaO: 35 to 55% (% by mass, hereinafter the same),
$SiO_2$: 10 to 30%,
$Al_2O_3$: 4.0% or less (excluding 0%),
F: 7 to 13%,
MgO: 0.2 to 1.0%,
$Li_2O$: 7 to 13%,
C, 10.5 to 14%, and inevitable impurities and satisfies the following expressions (4) and (5):

$$1.6 \leqq [T\text{—}CaO]/[SiO_2] \leqq 5 \quad (4); \text{ and}$$

$$0.2 \leqq [Li_2O]/[SiO_2] \leqq 1.1 \quad (5)$$

wherein [T—CaO], [$SiO_2$], and [$Li_2O$] denote respective contents (% by mass) of T—CaO, $SiO_2$, and $Li_2O$ in the mold powder.

EFFECTS OF THE INVENTION

According to the production method of the first aspect of the invention, the composition of the mold powder is adjusted properly and at the same time the continuous casting condition is properly controlled, so that formation of the depressions in the slab surface and occurrence of cracking can be prevented and a high-Al steel excellent in the surface quality can be produced.

If the mold powder of the second aspect of the invention is used for continuous casting, formation of the depressions in the slab surface and occurrence of cracking can be prevented and a high-aluminum steel excellent in the surface quality can be produced.

BEST MODE FOR CARRYING OUT THE INVENTION

The inventors of the invention have made various investigations to solve the above-mentioned problems and consequently have found that the above-mentioned object can superbly be accomplished by properly adjusting the composition of a mold powder and properly controlling the continuous casting condition and these findings now leads to the completion of the invention. First, the mold powder to be used in the invention will be described.

With the mold powders proposed before, in the case of employing a high-Al steel, it is difficult to stably produce cuspidine because of composition fluctuation. Therefore, the inventors of the invention have made investigations on crystallization of crystals which can be used in place of cuspidine in the slag film.

However, because of the moderate cooling, if crystallization of crystals such as dicalcium silicate ($2CaO.SiO_2$), mayenite ($12CaO.7Al_2O_3$), and gehlenite ($3CaO.2SiO_2.Al_2O_3$) is carried out, it leads to a problem of significant temperature fluctuation of a mold copperplate and further it is not effective for prevention of the depressions and cracking on the slab. Since they are unevenly crystallized as coarse crystals in a slag film, uneven projections and recessions (air layer) are formed on the surface in the mold side and as a result, the heat extraction speed becomes uneven. Consequently, the thickness of the solidified shell becomes uneven and therefore, it is supposed that the depressions and cracks are to be formed in the slab surface due to the transformation shrinkage.

Therefore, as a result of the various investigations, the inventors of the invention have found that crystallization of $LiAlO_2$ in place of cuspidine in a slag film can effectively prevent the depressions and cracks in the slab. The accurate mechanism of preventing the depressions and cracks in the slab by crystallization of $LiAlO_2$ is unclear; however it is supposed as follows.

Since $LiAlO_2$ is evenly crystallized as a fine crystal on the slag film in the mold surface, a uniform air layer can be formed. As a result, uniform heat extraction can be accomplished and the fluctuation of the temperature of the mold copper plate is small and cracking can be prevented due to the moderate cooling and in addition, a solidified shell with an even thickness is formed and therefore, it is supposed that the depressions and cracking of a slab due to transformation shrinkage can be suppressed. However, the invention is not limited to such an assumed mechanism.

The mold powder to be used for the invention aims to crystallize $LiAlO_2$ by causing reaction of $Li_2O$ from the mold powder on $Al_2O_3$ formed by reaction of Al from the molten steel and $SiO_2$ from the mold powder. That is, in the continuous casting of a high-Al steel, the mold powder crystallizes $LiAlO_2$ by utilizing reaction of $SiO_2$ and Al which are causes of the composition fluctuation expressed by the above-mentioned expression (7). Since the mold powder crystallizes the $LiAlO_2$, it is required to properly adjust the respective component amounts, particularly the amounts of T-CaO, $SiO_2$, and $Li_2O$ as well as their mass ratio $[Li_2O]/[SiO_2]$ and the basicity [T—CaO]/$[SiO_2]$ in a proper range.

Further, the mold powder of the invention is characterized in that the respective components are adjusted in proper ranges in terms of guarantee of the lubricating property by adjusting the solidification temperature of the molten slag (mold powder) in a proper range. Hereinafter, the respective component amounts, the basicity [T—CaO]/$[SiO_2]$, and mass ratio $[Li_2O]/[SiO_2]$ in the mold powder of the invention will be described respectively.

[T—CaO: 35 to 55%]

In the mold powder to be used in the invention, "T—CaO" means a CaO amount (% by mass) in the case of conversion of the total Ca contained in the mold powder into CaO. The T—CaO amount in the mold powder is 35% or higher, preferably 38% or higher, more preferably 40% or higher and 55% or lower, preferably 50% or lower, and more preferably 48% or lower. If the T—CaO amount is less than 35%, $SiO_2$ is relatively increased and as a result, the $Al_2O_3$ amount is increased and comes out of the range where $LiAlO_2$ crystallization is easy to make crystallization of $LiAlO_2$ difficult. Further, gehlenite ($3CaO.2SiO_2.Al_2O_3$) tends to be produced easily. On the other hand, in the case where T—CaO exceeds 55%, $Li_2O$ and $SiO_2$ amounts are relatively lowered also in this case and as a result, the $Al_2O_3$ amount is decreased due to the reaction defined by the expression (7) to make it impossible to reliably keep a sufficient amount of $LiAlO_2$. Further, the solidification temperature of the molten slag becomes too high.

[$SiO_2$: 10 to 30%]

The $SiO_2$ amount is 10% or higher, preferably 15% or higher, and 30% or lower, preferably 28% or lower, and more preferably 25% or lower. If the amount of $SiO_2$, which is a glass forming component, is less than 10%, crystals tend to be easily grown and therefore coarse crystals are formed to form uneven projections and recessions in the slag film in the mold surface side. Further, the solidification temperature is also increased to deteriorate the lubricating property and produce slag bear easily. On the other hand, if the $SiO_2$ amount exceeds 30%, more gehlenite ($3CaO.2SiO_2.Al_2O_3$) and dicalcium silicate ($2CaO.SiO_2$) are crystallized than $LiAlO_2$.

[$Al_2O_3$: 4.0% or Less (Excluding 0%)]

In order to prevent increase in the solidification temperature and viscosity of the molten slag, the $Al_2O_3$ amount is 4.0% or lower, preferably 3% or lower, and more preferably 2% or lower. However, since $Al_2O_3$ is mixed as an inevitable impurity in the mold powder production, it is industrially difficult to make this amount be 0%.

[MgO: 0.2 to 1.0%]

The MgO amount is 0.2% or higher, preferably 0.3% or higher, more preferably 0.4% or higher, 1.0% or lower, preferably 0.9% or lower, and more preferably 0.8% or lower. MgO acts as a core for crystallization of crystals in the slag film. Therefore, if the MgO amount exceeds 1.0%, the amount of the core becomes too large and the crystallization of crystals cannot be controlled properly and particularly, depending on the mold powder composition, dicalcium silicate ($2CaO.SiO_2$) and mayenite ($12CaO.7Al_2O_3$) are sometimes crystallized preferentially. On the other hand, if the MgO amount is less than 0.2%, the amount of the core of crystals is too small, crystals are not sufficiently crystallized until the temperature reaches a low equilibrium temperature and especially immediately under the mold meniscus where the molten steel is at a high temperature, moderate cooling is hard to be carried out. Further, when the molten steel reaches the equilibrium temperature, coarse crystals are crystallized at once and therefore the heat extraction speed becomes uneven.

[$Li_2O$: 7 to 13%]

The $Li_2O$ is 7% or higher, preferably 7.5% or higher, more preferably 8.0% or higher, 13% or lower, preferably 12% or lower, and more preferably 11% or lower. If the $Li_2O$ amount is less than 7%, it becomes difficult to crystallize a sufficient amount of $LiAlO_2$, and the solidification temperature and viscosity of the molten slag are increased and accordingly it becomes impossible to reliably keep the lubricating property. On the other hand, even in the case where the $Li_2O$ amount exceeds 13%, the crystallization of $LiAlO_2$ becomes out of the optimum range and its crystallization amount is lowered and thus moderate cooling may not be accomplished in some cases. Further, the viscosity of the molten powder is remarkably lowered and an excess amount of the molten slag flows locally and pulsed flow is generated to cause a bad effect on stable operation of the continuous casting in some cases.

[F: 7 to 13%]

The F amount is 7% or higher, preferably 7.5% or higher, more preferably 8.0% or higher, 13% or lower, preferably 12% or lower, and more preferably 11% or lower. If the F amount is less than 7%, the viscosity of the molten slag is increased and accordingly it may become impossible to reliably keep the lubricating property. On the other hand, F has a role to suppress crystallization of $LiAlO_2$, and especially if the F amount exceeds 13%, the crystallization amount of $LiAlO_2$ is sharply decreased.

[C: 10.5 to 14%]

This C amount expresses the total amount of C contained in the mold powder. That is, the C amount means the total carbon amount of carbon as a simple substance (free C amount) added as a mold powder raw material and carbon in a compound such as $Li_2CO_3$ added as a $Li_2O$ raw material. The C amount of the mold powder is 10.5% or higher, preferably 11.0% or higher, more preferably 11.5% or higher, 14% or lower, preferably 13.5% or lower, and more preferably 13% or lower. If the C amount is less than 10.5%, the melting speed of the mold powder becomes so high that the flow amount becomes too large and uneven flow is generated. As a result, vertical cracking of a slab tends to be caused easily. On the other hand, if the C amount exceeds 14%, the melting speed becomes too slow to reliably obtain a sufficient slag film thickness. As a result, at the time of melt surface fluctuation in the mold occurring inevitably in the industrial production, film cutting of the slag film is caused to result in deterioration of the surface quality of the slab due to sticking or abrupt cooling of the molten steel due to direct contact with the mold.

The mold powder to be used in the invention contains the above-mentioned components and inevitable impurities. In a common mold powder, $Na_2O$ and $K_2O$ are added to lower the solidification temperature; however, the mold powder of the invention is also characterized in that it does not contain these oxides. It is because in the continuous casting of a high-aluminum steel which the invention aims to achieve, chemical reactions defined by the following reaction formulas (8) and (9):

$$2Al+3Na_2O \rightarrow Al_2O_3+6Na \quad (8) \text{ and}$$

$$2Al+3K_2O \rightarrow Al_2O_3+6K \quad (9):$$

are caused and thus $Na_2O$ and $K_2O$ are consumed and their action is not exhibited sufficiently, and $Al_2O_3$ is produced beyond expectation and it causes a bad effect on the solidification temperature of the molten slag. Further, if $Na_2O$ exists, an Na—Al—O crystal is unevenly crystallized to form uneven projections and recessions (air layer) of the slag film in some cases.

[$1.6 \leqq [T—CaO]/[SiO_2] \leqq 5$]

The basicity $[T—CaO]/[SiO_2]$ is 1.6 or higher, preferably 1.8 or higher, more preferably 2.0 or higher, 5 or lower, preferably 4 or lower, and more preferably 3 or lower. If the basicity is lower than 1.6, the $SiO_2$ amount is relatively increased and comes out of the range where crystallization of $LiAlO_2$ is easy and thus crystallization of $LiAlO_2$ tends to be difficult. Further, gehlenite ($3CaO.2SiO_2.Al_2O_3$) tends to be produced easily. On the other hand, if the basicity exceeds 5, the $SiO_2$ is also relatively decreased and along with that, the $Al_2O_3$ amount and $LiAlO_2$ amount are decreased. Further, the amount of $SiO_2$ which is a glass forming component, is decreased, so that the mayenite ($12CaO.7Al_2O_3$) is excessively developed. Further, the solidification temperature is increased to cause a bad effect on the lubricating property in some cases.

[$0.2 \leqq [Li_2O]/[SiO_2] \leqq 1.1$]

The mass ratio $[Li_2O]/[SiO_2]$ is 0.2 or higher, preferably 0.3 or higher, more preferably 0.4 or higher, 1.1 or lower, preferably 1.0 or lower, and more preferably 0.9 or lower. If $[Li_2O]/[SiO_2]$ is less than 0.2, since the $Li_2O$ amount becomes insufficient, $LiAlO_2$ is not produced sufficiently. On the other hand, if $[Li_2O]/[SiO_2]$ exceeds 1.1, since it is out of the optimum range for $LiAlO_2$ crystallization, it becomes difficult to crystallize $LiAlO_2$.

The solidification temperature of the mold powder (molten slag) of the invention is preferably 950 to 1200° C. and more preferably 1000 to 1150° C. If the solidification temperature is lower than 950° C., it becomes difficult to crystallize the crystals and thus it may sometimes result in impossibility of sufficiently causing the effect of moderate cooling. On the other hand, if the solidification temperature exceeds 1200° C., slag bear is produced and because of uneven flow-in due to the slag bear, breakout and cracking of the slab surface may possibly be caused.

The Al content in the steel to be continuously cast (the Al content in a molten steel) is 0.1% or higher, preferably 0.3% or higher, more preferably 0.5% or higher, 2.5% or lower, preferably 2.0% or lower, and more preferably 1.7% or lower in order to sufficiently exert the effect of the mold powder. Herein, the dissolved Al amount in the steel means the amount of Al dissolved in the molten steel used for the continuous casting and the amount excludes the amount of Al precipitated (that is, not dissolved) in form of $Al_2O_3$ or the like.

In the hypo-peritectic steel, to which the invention is applied, the contents of the basic components of Si, Mn, Al, Ni, Cr and Mo are assumed to be 4.0% or less (excluding 0%) each and satisfy the above-mentioned expressions (1) to (3). Although other components besides the above-mentioned components substantially contain iron and also include inevitable impurities such as S, P, and Cu as well as trace amounts of allowable components (e.g. 0.2% or less of Ti, Nb, and the like).

In the invention, to accomplish the above-mentioned object, it is required to control the continuous casting conditions properly. These conditions will be described in the following.

[Molten Steel Surface Level Fluctuation Speed in the Mold: 14 mm/Second or Lower]

The molten steel surface level fluctuation speed in the mold has to be controlled in a proper range to keep the stability of the mold powder melt pool. If the fluctuation speed exceeds 14 mm/second, the mold powder melt pool is cut and the molten steel is brought into direct contact with the mold copper plate and the heat extraction speed in the mold becomes uneven. As a result, the fluctuation of the thermocouple temperature of the mold becomes significant and the depressions and cracks tend to be caused easily. The fluctuation speed is preferable to be 10 mm/second or lower. To control the molten steel surface level fluctuation speed in the mold within the above-mentioned range, depending on the casting condition, the gas flow rate of Ar for preventing nozzle clogging may be optimized and the pouring hole shape of the immersion nozzle may be optimized.

[Pouring the Molten Steel in the Width Direction of the Mold by Using an Immersion Nozzle at a Pouring Angle of 0° or More and 55° or Less Downward from the Horizontal Direction]

The immersion nozzle to be used in the mold is required to have the molten steel pouring direction in the width direction of the mold. If the molten steel pouring direction is in the thickness direction, the molten steel pouring flow hits a specified portion of the solidified shell in the wide face side of the mold and the heat extraction state at the portion becomes different from that at the other portions and the portion tends to be a starting point of the depressions and cracks in a type of steel with high transformation shrinkage. The pouring angle of the immersion nozzle (pouring direction angle) is preferably 0° or higher and 55° or lower downward from the horizontal direction. If the pouring angle of the immersion nozzle is less than 0° (that is, upward), the poured molten steel directly flows to the interface between the molten mold powder and the molten steel bath surface and thus the interface is put in a state of a high temperature and stirred and the reaction between the dissolved Al in the molten steel and $SiO_2$ in the mold powder defined by the above-mentioned expression (7) is too intensely promoted to control the mold powder composition properly. If the pouring angle of the immersion nozzle becomes 55° or more downward from the horizontal direction, the molten steel pouring flow at a high temperature becomes mainly the flow toward the lower part of the mold and the molten steel bath surface temperature in the mold is lowered too much. In such a case, slag bear is generated in the mold powder having a relatively high solidification temperature and uneven mold powder flow is generated to sometimes cause vertical cracking.

[Stroke in the Amplitude: Beyond 2 mm and 8 mm or Less and the Negative Strip Time tN Defined by the Following Expression (6): 0.28 Seconds or Shorter]

In the case of continuous casting, generally a slab is pulled out downward while the mold is being oscillated and as this mold oscillation condition, it is required that the stroke in the amplitude determined by the distance between the upper dead point and the lower dead point of the mold is in a range beyond 2 mm and 8 mm or less and that the mold oscillation is adjusted to control the negative strip time tN defined by the following expression (6) to 0.28 seconds or shorter:

$$tN=(1/\pi f)\cos^{-1}(Vc/\pi f s) \quad (6)$$

(in the formula; f denotes the mold oscillation frequency (Hz); denotes the distance (mm) between the upper dead point and the lower dead point of the mold at the time of mold oscillation; and Vc denotes the casting velocity (mm/s) of a slab).

If the above-mentioned stroke is 2 mm or lower, the flow amount of the mold powder is extremely decreased and the sticking on frequency between the mold and the slab is increased and the risk of breakout is increased and thus it becomes difficult to realize stable casting. Further, if the stroke exceeds 8 mm, intervals of oscillation marks become wide and the shrinkage stress in an initial casting period cannot be distributed but concentrated on the oscillation marks to form depressions.

The negative strip time tN defined by the above-mentioned expression (6) is known as an index showing the oscillation mark depth in consideration of the amplitude (e.g. Iron and Steel Handbook II, Iron manufacturing and Steel manufacturing Ver. 3, The Iron and Steel Institute of Japan, p. 638) and it is said that as this value is smaller, the oscillation mark depth is made shallower (e.g. Iron and Steel, 67 (1981), p. 1190). Further, in the case of continuous casting of a steel product, the negative strip time tN is set to be about 0.35 second. However, according to the results of the investigations by the inventors of the invention, it is required to control the negative strip time tN defined by the expression (6) to be 0.28 seconds or shorter for continuous casting of the high-Al steel to which the invention is applied. That is, if the negative strip time tN is larger than 0.28 seconds, the kinetic energy downward to the mold is transmitted from the powder and due to the meniscus pressure generated in the powder, the oscillation mark depth is made large and accordingly the deformation stress owing to solidification and transformation is concentrated in the valley parts of the oscillation marks to induce transverse cracking. The upper limit of the negative strip time tN is preferably 0.25 seconds.

The basic casting condition in the method of the invention is as described above; however, it is also effective to carry out electromagnetic stirring in the mold depending on the necessity. Execution of the electromagnetic stirring evenly fluidize the molten steel in the mold and since the temperature of the molten steel coming into collision with the solidified shell is made even, the heat input in the width direction of a slab is made even to give a uniform solidified shell and prevent the depressions and vertical cracking. To cause the above-mentioned effect, the magnetic flux density at the time of electromagnetic stirring is preferably 300 gauss or higher and more preferably 500 gauss or higher. However, if the magnetic flux density becomes too high, the molten steel flow speed in the molten steel surface becomes so high as to intensely promote the reaction defined by the above-mentioned expression (6) and it sometimes result in impossibility of the control of proper mold powder composition and therefore, it is preferable to be 1200 gauss or lower.

EXAMPLES

Hereinafter, the invention will be described more in detail with reference to Examples; however, it is not intended that the invention be limited to the illustrated Examples. Modifications can be made appropriately as long as conforming to the spirit and scope of the invention described hereinabove and hereinbelow and all such modifications are included in the technical scope of the invention.

Example 1

Molten steels of 240 t per 1 heat were cast using a vertically curved type continuous casting apparatus. In this Example, molten steels (steel types) of various chemical component compositions as shown in the following Table 1 were used and mold powders of the compositions shown in the following Table 2 were used. In this case, the mold size in the continuous casting was 240×1230 mm and the casting speed was 1.4 m/minute.

TABLE 1

| Steel | Chemical component composition of molten steel (% by mass) | | | | | | | | | | |
|---|---|---|---|---|---|---|---|---|---|---|---|
| type | C | Si | Mn | P | S | Al | Ni | Mc | Cr | f1--0.10 | f2+0.05 |
| A | 0.15 | 0.04 | 1.7 | 0.03 | 0.0010 | 1.5 | 1.6 | 0.02 | 0.01 | 0 | 0.40 |
| B | 0.15 | 0.03 | 2.2 | 0.008 | 0.0007 | 1.5 | 0.01 | 0.10 | 0.10 | 0.06 | 0.33 |
| C | 0.15 | 0.03 | 2.1 | 0.003 | 0.0006 | 1.6 | 0.80 | 0.01 | 0.20 | 0.04 | 0.30 |
| D | 0.18 | 0.04 | 2.1 | 0.005 | 0.0009 | 1.7 | 0.01 | 0.05 | 0.10 | 0.08 | 0.37 |
| E | 0.10 | 0.40 | 1.7 | 0.008 | 0.0010 | 1.3 | 0.01 | 0.01 | 0.01 | 0.07 | 0.33 |

TABLE 2

| Test | Steel | Mold powder composition (% by mass) | | | | | | | | | |
|---|---|---|---|---|---|---|---|---|---|---|---|
| No. | type | T-CaO | $SiO_2$ | $Al_2O_3$ | MgO | $Li_2O$ | F | C | NaO + $K_2O$ | [T-CaO]/[$SiO_2$] | [$Li_2O$]/[$SiO_2$] |
| 1 | A | 47.4 | 20.6 | 3.1 | 0.7 | 9.2 | 8.5 | 10.5 | 0 | 2.3 | 0.4 |
| 2 | A | 49.7 | 26.5 | 1.1 | 0.8 | 9.9 | 7.0 | 10.7 | 0 | 1.9 | 0.4 |
| 3 | C | 43.7 | 26.2 | 0.5 | 0.7 | 8.7 | 13.0 | 11.0 | 0 | 1.7 | 0.3 |
| 4 | C | 49.1 | 30.7 | 0.3 | 0.2 | 7.4 | 7.0 | 10.5 | 0 | 1.6 | 0.2 |
| 5 | C | 53.8 | 10.8 | 2.0 | 0.7 | 11.8 | 10.0 | 10.5 | 0 | 5.0 | 1.1 |
| 6 | B | 50.9 | 14.5 | 2.0 | 0.3 | 12.4 | 9.2 | 10.7 | 0 | 3.5 | 0.9 |
| 7 | E | 48.4 | 19.2 | 3.0 | 0.9 | 9.1 | 8.4 | 11.0 | 0 | 2.5 | 0.5 |
| 8 | C | 45.8 | 26.9 | 1.0 | 0.5 | 10.1 | 7.5 | 13.5 | 0 | 1.7 | 0.4 |
| 9 | C | 43.7 | 27.3 | 4.0 | 0.7 | 9.1 | 13.0 | 10.8 | 0 | 1.6 | 0.3 |
| 10 | D | 41.0 | 27.0 | 3.0 | 0.8 | 10.8 | 10.5 | 11.2 | 0 | 1.8 | 0.3 |
| 11 | A | 46.4 | 20.2 | 3.2 | 0.7 | 9.0 | 8.5 | 15.0 | 0 | 2.3 | 0.4 |
| 12 | A | 46.8 | 25.0 | 1.0 | 0.1 | 9.4 | 7.0 | 10.7 | 0 | 1.9 | 0.4 |
| 13 | C | 40.3 | 24.2 | 2.3 | 1.2 | 8.1 | 13.0 | 11.0 | 0 | 1.7 | 0.3 |
| 14 | C | 62.6 | 10.3 | 4.1 | 0.7 | 8.2 | 7.0 | 10.5 | 0 | 6.1 | 0.8 |
| 15 | C | 52.1 | 9.3 | 4.0 | 0.7 | 10.5 | 11.0 | 13.7 | 0 | 5.6 | 1.1 |
| 16 | C | 52.6 | 10.5 | 2.0 | 0.7 | 13.7 | 10.0 | 10.5 | 0 | 5.0 | 1.3 |
| 17 | B | 58.9 | 16.8 | 2.0 | 0.7 | 1.7 | 9.2 | 10.7 | 0 | 3.5 | 0.1 |
| 18 | E | 48.3 | 19.2 | 6.0 | 0.7 | 9.0 | 5.8 | 11.0 | 0 | 2.5 | 0.5 |
| 19 | C | 38.9 | 22.9 | 1.5 | 0.7 | 8.6 | 14.0 | 13.5 | 0 | 1.7 | 0.4 |
| 20 | C | 38.4 | 27.4 | 0.5 | 0.7 | 9.1 | 13.0 | 10.8 | 0 | 1.4 | 0.3 |
| 21 | D | 64.4 | 10.6 | 3.6 | 0.7 | 2.5 | 7.0 | 11.2 | 0 | 6.1 | 0.2 |
| 22 | C | 40.9 | 25.6 | 4.2 | 0.7 | 13.7 | 13.0 | 7.1 | 0 | 1.6 | 0.3 |
| 23 | C | 29.8 | 36.2 | 3.2 | 0.7 | 10.5 | 10.5 | 7.0 | 2.2 | 0.8 | 0.2 |

As an indicator of the lubricating property, the solidification temperature of the mold powder (molten slag) was calculated. The solidification temperature (° C.) was calculated from the viscosity η and the temperature T of the molten slag. Specifically, the viscosity η of the molten slag was continuously measured while the temperature being increased by a vibration reed method and the logarithm log η of the viscosity η was plotted in the Y-axis and the inverse number 1/T of the temperature T at the time of measuring the viscosity was plotted in the abscissa axis to form a graph and the temperature T corresponding to the inflexion point in the graph was measured as the solidification temperature.

As an indicator of the moderate cooling, the mold heat flux ($MW/m^2$) was calculated. The mold heat flux was calculated by measuring the total extracted heat quantity of the mold from the flow rate of the mold cooling water and the temperature difference between the inlet and the outlet and dividing the measured value by the contact surface area of the mold copper plate with the slab. If the heat flux value was 1.5 $MW/m^2$ or higher, it was determined to be "forcible cooling" and if it was less than 1.5 $MW/m^2$, it was determined to be "moderate cooling".

As an indicator of stable operation of the continuous casting, the temperature fluctuation (° C.) in a prescribed portion of casting carried out at a constant speed was measured using a thermocouple embedded in a mold copper plate. In the continuous casting, if the temperature fluctuation exceeds 15° C., the deceleration of the casting speed may be carried out, and if the fluctuation still cannot be ceased, the casting operation has to be ceased in some cases.

The depressions and cracking were evaluated as an indicator of the surface quality of slabs. The depressions of the slab surfaces were evaluated by arbitrarily extracting portions of two slabs cast in a steady state from 1 heat, carrying out inspection by eye observation for the front and the rear faces of the wider faces of the slabs, measuring the depth of the depressions in the portions where the depressions were observed, and determining that those having the depressions with a depth of 2 mm or deeper were "having depression". The cracking of the slab surfaces was evaluated by carrying out eye observation of the front face and the rear face of the wider faces of the slabs and determining that those having at least one crack with a length of 100 mm or longer were "having cracks".

These results are shown in the following Table 3 together with the continuous casting conditions (fluctuation speed of the melt surface level in the mold, immersion nozzle pouring angle, electromagnetic stirring magnetic flux density, mold oscillation stroke, and negative strip time tN).

TABLE 3

| Test No. | Steel Type | Solidification temperature (° C.) | Fluctuation speed of the melt surface level in the mold (mm/s) | Immersion nozzle pouring angle (°) | Electromagnetic stirring magnetic flux density (G) | Mold oscillation stroke (mm) | tN (s) | Mild heat flux ($MW/m^2$) | | Fluctuation of temperature of mold thermocouple (° C.) | Depression in slab | Vertical cracking | Remark |
|---|---|---|---|---|---|---|---|---|---|---|---|---|---|
| 1 | A | 1055 | 2.2 | 35 | 500 | 6 | 0.13 | 1.23 | Moderate cooling | 5 | None | None | Example |
| 2 | A | 1080 | 9.1 | 30 | 650 | 6 | 0.15 | 1.31 | Moderate cooling | 7 | None | None | Example |
| 3 | C | 1110 | 4.1 | 15 | 1000 | 6 | 0.19 | 1.39 | Moderate cooling | 11 | None | None | Example |
| 4 | C | 1120 | 3.5 | 10 | 1200 | 6 | 0.23 | 1.45 | Moderate cooling | 13 | None | None | Example |
| 5 | C | 1105 | 11.5 | 30 | 500 | 6 | 0.17 | 1.41 | Moderate cooling | 6 | None | None | Example |
| 6 | B | 1040 | 6.2 | 55 | 650 | 6 | 0.15 | 1.49 | Moderate cooling | 10 | None | None | Example |
| 7 | E | 1065 | 13.5 | 35 | 650 | 8 | 0.15 | 1.26 | Moderate cooling | 6 | None | None | Example |
| 8 | C | 1040 | 3.3 | 15 | 1000 | 6 | 0.19 | 1.41 | Moderate cooling | 11 | None | None | Example |
| 9 | C | 1080 | 2.9 | 10 | 1200 | 4 | 0.11 | 1.31 | Moderate cooling | 9 | None | None | Example |
| 10 | D | 1005 | 4.1 | 20 | 1000 | 3 | 0.05 | 1.30 | Moderate cooling | 8 | None | None | Example |
| 11 | A | 1070 | 2.2 | 35 | 500 | 6 | 0.13 | 1.46 | Moderate cooling | 15 | None | Present | Comparative Example |
| 12 | A | 1060 | 9.1 | 30 | 650 | 6 | 0.15 | 1.41 | Moderate cooling | 16 | Present | Present | Comparative Example |
| 13 | C | 1077 | 4.2 | 15 | 1000 | 6 | 0.19 | 1.41 | Moderate cooling | 22 | Present | Present | Comparative Example |
| 14 | C | 1290 | 3.5 | 10 | 1200 | 6 | 0.23 | 1.32 | Moderate cooling | 16 | Present | Present | Comparative Example |
| 15 | C | 1205 | 6.8 | 35 | 650 | 6 | 0.13 | 1.43 | Moderate cooling | 18 | Present | Present | Comparative Example |
| 16 | C | 1185 | 11.5 | 30 | 500 | 6 | 0.17 | 1.49 | Moderate cooling | 24 | Present | Present | Comparative Example |
| 17 | B | 1305 | 6.2 | 55 | 650 | 6 | 0.15 | 1.39 | Moderate cooling | 28 | Present | Present | Comparative Example |
| 18 | E | 1055 | 13.5 | 35 | 650 | 8 | 0.15 | 1.42 | Moderate cooling | 25 | Present | Present | Comparative Example |
| 19 | C | 1075 | 3.3 | 15 | 1000 | 6 | 0.19 | 1.38 | Moderate cooling | 22 | Present | Present | Comparative Example |
| 20 | C | 1055 | 2.9 | 10 | 1200 | 4 | 0.11 | 1.39 | Moderate cooling | 16 | Present | Present | Comparative Example |
| 21 | D | 1320 | 4.1 | 20 | 1000 | 3 | 0.05 | 1.41 | Moderate cooling | 31 | None | Present | Comparative Example |
| 22 | C | 930 | 2.9 | 10 | 1200 | 4 | 0.11 | 1.65 | Forcible cooling | 13 | None | Present | Comparative Example |
| 23 | C | 925 | 13.9 | 0 | 1200 | 4 | 0.16 | 1.71 | Forcible cooling | 36 | None | Present | Comparative Example |

As being made clear from these results, with respect to those which satisfied the conditions defined by the invention (test Nos. 1 to 10), moderate cooling could be carried out or the fluctuation of temperature of mold thermocouple could be stabilized and thus slabs free from the depressions and cracks and excellent in the surface quality could be produced. On the other hand, for those using mold powders which failed to satisfy the conditions defined by the invention (test Nos. 11 to 23), moderate cooling could not be carried out or many crystals other than $LiAlO_2$ were crystallized and the lubricating property was inferior and consequently, the slabs were found having the depressions or cracks.

Specifically, with respect to the test No. 11, since the C content of the mold powder was excess and the melting was insufficient, the portions where the flag film was not formed sufficiently were quenched to lead to occurrence of cracking. With respect to the test No. 12, since the MgO content in the mold powder was small, coarse crystals were crystallized and therefore the heat extraction speed became uneven, resulting in formation of the depressions and cracks in the slab.

With respect to the test No. 13, since the MgO content in the mold powder was large, the mayenite or the like was crystallized preferentially and therefore the heat extraction speed became uneven, resulting in formation of the depressions and cracks. With respect to the test Nos. 14 and 15, since the $SiO_2$ content in the mold powder was small, a large quantity of slab bear was generated, resulting in formation of the depressions and cracks in the slab.

With respect to the test No. 16, the $Li_2O$ content in the mold powder was large and as a result, $[Li_2O/SiO_2]$ was increased and excess flow occurred due to the decrease in the viscosity and the flow was consequently pulsed and the temperature fluctuation of the thermocouple in the mold became significant. Further, any proper lubricating property could be retained, resulting in formation of the depressions and cracks in the slab.

With respect to the test No. 17, the $Li_2O$ content in the mold powder was small and as a result, [$Li_2O/SiO_2$] was lowered and the viscosity and solidification temperature were high and sufficient consumption of the basic unit was not attained and thus the lubricating property could not be guaranteed and large quantities of the mayenite and dicalcium silicate were crystallized and therefore the heat extraction speed became uneven, resulting in formation of the depressions and cracks.

With respect to the test No. 18, since the F content in the mold powder was small, the viscosity was increased and any sufficient lubricating property could not be guaranteed, resulting in formation of the depressions and cracks. With respect to the test No. 19, since the F content in the mold powder was large, the $LiAlO_2$ amount was extremely lessened, resulting in incompletion of moderate cooling and formation of the depressions and cracks.

With respect to the test No. 20, since the basicity [T—CaO] [$SiO_2$] was lowered and a large quantity of coarse gehlenite was crystallized, the heat extraction speed became uneven, resulting in formation of cracks in the slab. With respect to the test No. 21, the content of $Li_2O$ in the mold powder was lowered and the solidification temperature was increased too much to attain a proper lubricating property and thus cracks were formed in the slab.

With respect to the test No. 22, the content of $Li_2O$ in the mold powder was too large and the heat extraction speed became uneven, resulting in formation of cracks in the slab. With respect to the test No. 23, since the basicity [T—CaO]/[$SiO_2$] was lowered and a large quantity of coarse gehlenite was crystallized, the heat extraction speed became uneven, resulting in formation of cracks in the slab. Further, since $Na_2O$ also existed, an Na—Al—O crystal was unevenly crystallized and it was supposed that the crystal also affected badly on the heat extraction speed. Further, a large quantity of gehlenite was produced and the crystals became unstable and moderate cooling was not accomplished.

Example 2

Steels as described in Table 1 were cast in the same manner as in Example 1, except that molten steels (steel types) of various chemical component compositions as shown in Table 1 were used and mold powders of the compositions shown in the following Table 4 were used. In this case, the continuous casting conditions (fluctuation speed of the melt surface level in the mold, immersion nozzle pouring angle, electromagnetic stirring magnetic flux density, mold oscillation stroke, and negative strip time tN) were controlled as in the following Table 5.

TABLE 4

| Test No. | Steel type | Mold powder composition (% by mass) T-CaO | $SiO_2$ | $Al_2O_3$ | MgO | $Li_2O$ | F | C | $NaO + K_2O$ | [T-CaO]/[$SiO_2$] | [$Li_2O$]/[$SiO_2$] |
|---|---|---|---|---|---|---|---|---|---|---|---|
| 24 | C | 47.4 | 20.6 | 3.1 | 0.7 | 9.2 | 8.5 | 10.5 | 0 | 2.3 | 0.4 |
| 25 | C | 49.7 | 26.5 | 1.1 | 0.8 | 9.9 | 7.0 | 5.0 | 0 | 1.9 | 0.4 |
| 26 | C | 47.4 | 20.6 | 3.1 | 0.7 | 9.2 | 8.5 | 10.5 | 0 | 2.3 | 0.4 |
| 27 | C | 49.7 | 26.5 | 1.1 | 0.8 | 9.9 | 7.0 | 5.0 | 0 | 1.9 | 0.4 |
| 28 | C | 47.4 | 20.6 | 3.1 | 0.7 | 9.2 | 8.5 | 10.5 | 0 | 2.3 | 0.4 |
| 29 | C | 49.7 | 26.5 | 1.1 | 0.8 | 9.9 | 7.0 | 5.0 | 0 | 1.9 | 0.4 |
| 30 | C | 47.4 | 20.6 | 3.1 | 0.7 | 9.2 | 8.5 | 10.5 | 0 | 2.3 | 0.4 |
| 31 | C | 49.7 | 26.5 | 1.1 | 0.8 | 9.9 | 7.0 | 5.0 | 0 | 1.9 | 0.4 |
| 32 | D | 47.4 | 20.6 | 3.1 | 0.7 | 9.2 | 8.5 | 10.5 | 0 | 2.3 | 0.4 |
| 33 | D | 49.7 | 26.5 | 1.1 | 0.8 | 9.9 | 7.0 | 5.0 | 0 | 1.9 | 0.4 |
| 34 | C | 47.4 | 20.6 | 3.1 | 0.7 | 9.2 | 8.5 | 10.5 | 0 | 2.3 | 0.4 |
| 35 | C | 49.7 | 26.5 | 1.1 | 0.8 | 9.9 | 7.0 | 5.0 | 0 | 1.9 | 0.4 |
| 36 | D | 47.4 | 20.6 | 3.1 | 0.7 | 9.2 | 8.5 | 10.5 | 0 | 2.3 | 0.4 |
| 37 | D | 49.7 | 26.5 | 1.1 | 0.8 | 9.9 | 7.0 | 5.0 | 0 | 1.9 | 0.4 |
| 38 | D | 48.4 | 19.2 | 3.0 | 0.9 | 9.1 | 8.4 | 11.0 | 0 | 2.5 | 0.5 |
| 39 | D | 47.4 | 20.6 | 3.1 | 0.7 | 9.2 | 8.5 | 10.5 | 0 | 2.3 | 0.4 |
| 40 | D | 47.4 | 20.6 | 3.1 | 0.7 | 9.2 | 8.5 | 10.5 | 0 | 2.3 | 0.4 |
| 41 | D | 49.7 | 26.5 | 1.1 | 0.8 | 9.9 | 7.0 | 5.0 | 0 | 1.9 | 0.4 |
| 42 | D | 48.4 | 19.2 | 3.0 | 0.9 | 9.1 | 8.1 | 11.0 | 0 | 2.5 | 0.5 |

TABLE 5

| Test No. | Steel type | Solidification temperature (° C.) | Fluctuation Speed of the melt surface level in the mold (mm/s) | Immersion nozzle pouring angle (°) | Electromagnetic stirring magnetic flux density (g) | Mold oscillation stroke (mm) | tN (s) | Mold heat flux ($MW/m^2$) | | Fluctuation of temperature of mold thermocouple (° C.) | Depression in slab | Vertical cracking | Remark |
|---|---|---|---|---|---|---|---|---|---|---|---|---|---|
| 24 | C | 1050 | 2.2 | 35 | 500 | 6 | 0.13 | 1.23 | Moderate cooling | 4 | None | None | Example |
| 25 | C | 1050 | 3.5 | 35 | 500 | 6 | 0.15 | 1.31 | Moderate cooling | 7 | None | None | Example |

TABLE 5-continued

| Test No. | Steel type | Solidification temperature (° C.) | Fluctuation Speed of the melt surface level in the mold (mm/s) | Immersion nozzle pouring angle (°) | Electromagnetic stirring magnetic flux density (g) | Mold oscillation stroke (mm) | tN (s) | Mold heat flux ($MW/m^2$) | | Fluctuation of temperature of mold thermocouple (° C.) | Depression in slab | Vertical cracking | Remark |
|---|---|---|---|---|---|---|---|---|---|---|---|---|---|
| 26 | C | 1055 | 15.2 | 35 | 500 | 6 | 0.13 | 1.25 | Moderate cooling | 21 | Present | None | Comparative Example |
| 27 | C | 1050 | 17.0 | 35 | 500 | 6 | 0.15 | 1.31 | Moderate cooling | 26 | Present | Present | Comparative Example |
| 28 | C | 1055 | 5.5 | 35 | 500 | 6 | 0.13 | 1.24 | Moderate cooling | 8 | None | None | Example |
| 29 | C | 1050 | 11.6 | −5 | 500 | 6 | 0.13 | 1.34 | Moderate cooling | 24 | Present | Present | Comparative Example |
| 30 | C | 1055 | 5.5 | 5 | 350 | 6 | 0.13 | 1.23 | Moderate cooling | 7 | None | None | Example |
| 31 | C | 1050 | 13.1 | 30 | 650 | 6 | 0.13 | 1.31 | Moderate cooling | 7 | None | None | Example |
| 32 | D | 1055 | 4.3 | 15 | 0 | 6 | 0.13 | 1.41 | Moderate cooling | 13 | None | None | Example |
| 33 | D | 1050 | 10.2 | 30 | 0 | 6 | 0.13 | 1.37 | Moderate cooling | 12 | None | None | Example |
| 34 | C | 1055 | 12.1 | 30 | 1200 | 6 | 0.13 | 1.22 | Moderate cooling | 11 | None | None | Example |
| 35 | C | 1050 | 11.6 | 35 | 1250 | 6 | 0.13 | 1.34 | Moderate cooling | 24 | Present | Present | Comparative Example |
| 36 | D | 1055 | 8.9 | 35 | 500 | 3 | 0.04 | 1.14 | Moderate cooling | 4 | None | None | Example |
| 37 | D | 1050 | 7.2 | 30 | 500 | 6 | 0.15 | 1.32 | Moderate cooling | 10 | None | None | Example |
| 38 | D | 1065 | 10.4 | 35 | 500 | 6 | 0.14 | 1.35 | Moderate cooling | 8 | None | None | Example |
| 39 | D | 1055 | 5.5 | 35 | 500 | 6 | 0.13 | 1.28 | Moderate cooling | 8 | None | None | Example |
| 40 | D | 1055 | 9.2 | 30 | 500 | 2 | 0.02 | 1.49 | Moderate cooling | 4 | Present | Present | Comparative Example |
| 41 | D | 1050 | 10.1 | 30 | 500 | 10 | 0.19 | 1.26 | Moderate cooling | 14 | Present | Present | Comparative Example |
| 42 | D | 1065 | 4.1 | 35 | 500 | 6 | 0.26 | 1.44 | Moderate cooling | 12 | Present | Present | Comparative Example |

For these test specimens, the lubricating property (solidification temperature), moderate cooling (mold heat flux), stable operation (temperature fluctuation), surface quality (depressions and cracks) of the slabs were evaluated in the same manner as in Example 1. The results are collectively shown in the above-mentioned Table 5.

As made clear from these results, with respect to those which satisfied the conditions defined by the invention (test Nos. 24, 25, 28, 30 to 34, 36 to 39), the moderate cooling and stabilization of the temperature fluctuation of thermocouple of the mold could be accomplished and with respect to those which were out of the casting conditions defined by the invention (test Nos. 26, 27, 29, 35, 40 to 42), it was found that the depressions and cracks were generated.

Specifically, with respect to test Nos. 26 and 27, the fluctuation speed of the melt surface level in the mold became significant and the heat extraction speed became uneven and as a result, the temperature fluctuation of the thermocouple of the mold became significant and the depressions or cracks were formed. With respect to test No. 29, the immersion nozzle pouring angle was −5° and the heat extraction speed became uneven and as a result, the temperature fluctuation of the thermocouple of the mold became significant and the depressions or cracks were formed.

With respect to test No. 35, the electromagnetic stirring magnetic flux density, which is a preferable requirement of the invention, became high and the heat extraction speed became uneven and as a result, the temperature fluctuation of the thermocouple of the mold became significant and the depressions or cracks were formed.

With respect to test No. 40, the stroke in the amplitude of the mold was 2 mm and the flow was insufficient and cracks were formed. With respect to test Nos. 41 and 42, intervals between oscillation marks were wide and the depressions and cracks were formed along with the oscillation marks.

Example 3

Cr—Mo-added steels were cast from a molten steel of 240 t per 1 heat using a vertically curved type continuous casting apparatus. In this Example, the mold powders of compositions shown in the following Table 6 and a molten steel containing 0.18% of C, 0.04% of Si, 2.1% of Mn, 1% or less of Cr, Mo, Ni, and P, 1.6% of dissolved Al, and balance of Fe and inevitable impurities were used. In the continuous casting, the mold size was 240×1230 mm and the casting speed was 1.4 m/minute.

TABLE 6

| No. | T-CaO (%) | $SiO_2$ (%) | $Al_2O_3$ (%) | MgO (%) | $Li_2O$ (%) | F (%) | C (%) | $Na_2O + K_2O$ (%) | T-CaO/$SiO_2$ | $Li_2O/SiO_2$ |
|---|---|---|---|---|---|---|---|---|---|---|
| 1 | 47.4 | 20.6 | 3.1 | 0.7 | 9.2 | 8.5 | 10.5 | 0 | 2.3 | 0.4 |
| 2 | 46.4 | 24.7 | 1.1 | 0.8 | 9.3 | 7.0 | 10.7 | 0 | 1.9 | 0.4 |
| 3 | 41.6 | 24.9 | 0.5 | 0.7 | 8.3 | 13.0 | 11.0 | 0 | 1.7 | 0.3 |
| 4 | 46.8 | 29.2 | 0.3 | 0.2 | 7.0 | 7.0 | 10.5 | 0 | 1.6 | 0.2 |
| 5 | 54.1 | 10.8 | 2.0 | 0.7 | 11.9 | 10.0 | 10.5 | 0 | 5.0 | 1.1 |
| 6 | 50.9 | 14.5 | 2.0 | 0.3 | 12.4 | 9.2 | 10.7 | 0 | 3.5 | 0.9 |
| 7 | 48.4 | 19.2 | 3.0 | 0.9 | 9.1 | 8.4 | 11.0 | 0 | 2.5 | 0.5 |
| 8 | 42.8 | 25.2 | 1.0 | 0.5 | 9.5 | 7.5 | 13.5 | 0 | 1.7 | 0.4 |
| 9 | 39.0 | 24.4 | 4.0 | 0.7 | 8.1 | 13.0 | 10.8 | 0 | 1.6 | 0.3 |
| 10 | 41.0 | 27.0 | 3.0 | 0.8 | 10.8 | 10.5 | 11.2 | 0 | 1.8 | 0.3 |
| 11 | 46.8 | 25.0 | 1.0 | 0.1 | 9.4 | 7.0 | 10.7 | 0 | 1.9 | 0.4 |
| 12 | 40.3 | 24.2 | 2.3 | 1.2 | 8.1 | 13.0 | 11.0 | 0 | 1.7 | 0.3 |
| 13 | 52.1 | 9.3 | 4.0 | 0.7 | 10.5 | 11.0 | 13.7 | 0 | 5.6 | 1.1 |
| 14 | 52.6 | 10.5 | 2.0 | 0.7 | 13.7 | 10.0 | 10.5 | 0 | 5.0 | 1.3 |
| 15 | 58.9 | 16.8 | 2.0 | 0.7 | 1.7 | 9.2 | 10.7 | 0 | 3.5 | 0.1 |
| 16 | 48.3 | 19.2 | 6.0 | 0.7 | 9.0 | 5.8 | 11.0 | 0 | 2.5 | 0.5 |
| 17 | 38.9 | 22.9 | 1.5 | 0.7 | 8.6 | 14.0 | 13.5 | 0 | 1.7 | 0.4 |
| 18 | 38.4 | 27.4 | 0.5 | 0.7 | 9.1 | 13.0 | 10.8 | 0 | 1.4 | 0.3 |
| 19 | 64.4 | 10.6 | 3.6 | 0.7 | 2.5 | 7.0 | 11.2 | 0 | 6.1 | 0.2 |
| 20 | 40.9 | 25.6 | 4.2 | 0.7 | 13.7 | 13.0 | 7.1 | 0 | 1.6 | 0.3 |
| 21 | 44.6 | 19.4 | 3.2 | 0.7 | 8.7 | 8.5 | 15.0 | 0 | 2.3 | 0.4 |
| 22 | 47.0 | 28.0 | 2.6 | 4.8 | 6.2 | 6.5 | 6.8 | 0 | 1.7 | 0.2 |
| 23 | 29.8 | 36.2 | 3.2 | 0.7 | 10.5 | 10.5 | 7.0 | 2.2 | 0.8 | 0.3 |

To investigate the amounts of $LiAlO_2$, cuspidine ($3CaO\text{-}2SiO_2\text{—}CaF_2$), dicalcium silicate ($2CaO.SiO_2$), mayenite ($12CaO.7Al_2O_3$), and gehlenite ($3CaO.2SiO_2.Al_2O_3$) existing in the slag films obtained in the mold powder, slag films were sampled from the mold after completion of the casting and the x-ray diffraction intensities of the respective crystals were measured by x-ray diffractometry (Cu bulb 40 kV, 200 mA). The degrees of their x-ray diffraction intensities are shown in Table 7.

TABLE 7

| No. | $LiAlO_2$ | Cuspidine ($3\ CaO•SiO_2•CaF_2$) | Dicalcium silicate ($2\ CaO•SiO_2$) | Mayenite ($12\ CaO•7Al_2O_3$) | Gehlenite ($2\ CaO•SiO_2•Al_2O_3$) |
|---|---|---|---|---|---|
| 1 | High | None | None | Middle | None |
| 2 | High | None | Middle | Small | None |
| 3 | High | None | Small | None | Small |
| 4 | Middle | None | Small | Small | None |
| 5 | High | None | None | None | None |
| 6 | High | None | Small | Small | None |
| 7 | High | None | Middle | Middle | Small |
| 8 | High | None | Middle | Small | None |
| 9 | High | None | Small | Small | None |
| 10 | High | Middle | None | None | Small |
| 11 | Small | None | High | High | Small |
| 12 | Small | Middle | Middle | High | Middle |
| 13 | Small | None | High | Middle | Small |
| 14 | Small | None | Middle | High | None |
| 15 | None | None | Middle | High | None |
| 16 | Small | None | Middle | High | Small |
| 17 | Small | Middle | High | Middle | None |
| 18 | Small | Middle | None | None | High |
| 19 | None | None | Middle | High | None |
| 20 | Small | Middle | Small | None | High |
| 21 | Small | None | Small | High | Small |
| 22 | Small | Small | None | Middle | High |
| 23 | Small | Small | None | None | High |

As an indicator of the lubricating property, the solidification temperature of the mold powder (molten slag) and the consumption amount were calculated. The solidification temperature (° C.) was calculated from the viscosity $\eta$ and the temperature T of the molten slag. Specifically, the viscosity $\eta$ of the molten slag was continuously measured while the temperature being increased by a vibration reed method and the logarithm log $\eta$ of the viscosity $\eta$ was plotted in the ordinate axis and the inverse number 1/T of the temperature T at the time of measuring the viscosity was plotted in the abscissa axis to form a graph and the temperature T corresponding to the inflexion point in the graph was measured as the solidification temperature. The consumption amount (kg/$m^2$) was measured by measuring the mold powder amount added to the mold every time of casting of a slab with a length of 10 m and dividing the added amount by the surface area of the slab obtained by the casting. These results are shown in Table 8. The values of the consumption amounts shown in Table 8 were the average values excluding of the casting speed decrease portions of the most top and most bottom parts in the casting.

As an indicator of the moderate cooling, the mold heat flux ($MW/m^2$) was calculated. The mold heat flux was calculated by measuring the total extracted heat quantity of the mold from the flow rate of the mold cooling water and the temperature difference between the inlet and the outlet and dividing the measured value by the contact surface area of the mold copper plate with the slab. If the heat flux value was 1.5 $MW/m^2$ or higher, it was determined to be "forcible cooling" and if it was less than 1.5 $MW/m^2$, it was determined to be "moderate cooling". The results are shown in Table 8.

As an indicator of stable operation of the continuous casting, the temperature fluctuation (° C.) in a prescribed portion of casting carried out at a constant speed was measured using a thermocouple embedded in a mold copper plate. The results are shown in Table 8. In the continuous casting, if the temperature fluctuation exceeds 15° C., the deceleration of the casting speed may be carried out, and if the fluctuation still cannot be ceased, the casting operation has to be ceased in some cases.

The depressions and cracking were evaluated as an indicator of the surface quality of slabs. The depressions in the slab surfaces were evaluated by arbitrarily extracting portions of two slabs cast in a steady state from 1 heat, carrying out inspection by eye observation for the front and the rear faces of the wider faces of the slabs, measuring the depth of the depressions in the portions where the depressions was observed, and determining that those having the depressions with a depth of 2 mm or deeper were "having depression". The cracking of the slab surfaces was evaluated by carrying out eye observation of the front face and the rear face of the wider faces of the slabs and determining that those having at least one crack with a length of 100 mm or longer were "having cracks". These results are shown in Table 8.

TABLE 8

| No. | Solidification temperature (° C.) | consumption amount ($kg/m^2$) | Heat flux ($MW/m^2$) | | Temperature fluctuation (° C.) | Depression | Cracking |
|---|---|---|---|---|---|---|---|
| 1 | 1055 | 0.35 | 1.23 | Moderate cooling | 5 | None | None |
| 2 | 1050 | 0.31 | 1.31 | Moderate cooling | 7 | None | None |
| 3 | 1110 | 0.32 | 1.39 | Moderate cooling | 11 | None | None |
| 4 | 1120 | 0.25 | 1.45 | Moderate cooling | 13 | None | None |
| 5 | 1105 | 0.33 | 1.41 | Moderate cooling | 6 | None | None |
| 6 | 1040 | 0.35 | 1.49 | Moderate cooling | 10 | None | None |
| 7 | 1065 | 0.30 | 1.26 | Moderate cooling | 6 | None | None |
| 8 | 1040 | 0.31 | 1.41 | Moderate cooling | 11 | None | None |
| 9 | 1080 | 0.29 | 1.31 | Moderate cooling | 9 | None | None |
| 10 | 1005 | 0.33 | 1.3 | Moderate cooling | 8 | None | None |
| 11 | 1060 | 0.36 | 1.41 | Moderate cooling | 16 | Present | Present |
| 12 | 1070 | 0.32 | 1.41 | Moderate cooling | 22 | Present | Present |
| 13 | 1205 | 0.41 | 1.32 | Moderate cooling | 18 | Present | Present |
| 14 | 1185 | 0.42 | 1.49 | Moderate cooling | 24 | Present | Present |
| 15 | 1305 | 0.19 | 1.39 | Moderate cooling | 28 | Present | Present |
| 16 | 1055 | 0.37 | 1.42 | Moderate cooling | 25 | Present | Present |
| 17 | 1075 | 0.37 | 1.38 | Moderate cooling | 22 | Present | Present |
| 18 | 1055 | 0.16 | 1.39 | Moderate cooling | 16 | Present | Present |
| 19 | 1320 | 0.19 | 1.41 | Moderate cooling | 31 | None | Present |
| 20 | 930 | 0.43 | 1.65 | Forcible cooling | 13 | None | Present |
| 21 | 1070 | 0.21 | 1.46 | Moderate cooling | 15 | None | Present |
| 22 | 1095 | 0.22 | 1.48 | Moderate cooling | 27 | Present | Present |
| 23 | 925 | 0.14 | 1.71 | Forcible cooling | 36 | None | Present |

As being made clear from the results in Tables 6 to 8, the mold powders Nos. 1 to 10 satisfying the conditions of the invention could actualize moderate cooling even if cuspidine was not formed in the slag films and made it possible to produce slabs free from the depressions and cracks and excellent in the surface quality. It is supposed that the moderate cooling can be accomplished by $LiAlO_2$ in the slag film. Further, it is also understood that the mold powders Nos. 1 to 10 have the solidification temperatures in the proper range and thus have a proper lubricating property. Further, in the case of continuous casting using them, temperature fluctuation was small and stable operation could be carried out.

On the contrary, in the case of continuous casting using the mold powders Nos. 11 to 23 which do not satisfy the conditions of the invention, nothing but only slabs having the depressions and cracks were obtained because of the following reasons.

Since the No. 11 was deficient in the MgO amount and coarse crystals were crystallized, the heat extraction speed became uneven and the depressions and cracks were generated in the slabs.

Since the No. 12 contained a large amount of MgO and mayenite or the like were crystallized preferentially, the heat extraction speed became uneven and the depressions and cracks were generated in the slabs.

Since the No. 13 was small in the $SiO_2$ amount, a large quantity of slag bear was produced and the depressions and cracks were generated in the slabs.

Since the No. 14 was large in the $Li_2O$ amount and $Li_2O/SiO_2$, it was supposed that the viscosity of the molten slag was decreased. Therefore, excess flow and pulses were caused to result in significant temperature fluctuation. Further, no proper lubricating property was attained to generate the depressions and cracks in the slab.

Since the No. 15 was small in $Li_2O$ amount and $Li_2O/SiO_2$, the solidification temperature and the viscosity of the molten slag became high and any proper lubricating property could not be attained and further large quantities of mayenite and dicalcium silicate were crystallized to make the heat extraction speed uneven and accordingly the depressions and cracks were generated in the slabs.

Since No. 16 was small in the F amount and the viscosity of the molten slag was increased, any proper lubricating property could not be attained and accordingly the depressions and cracks were generated in the slabs.

Since No. 17 was large in the F amount, $LiAlO_2$ was not sufficiently crystallized and the heat extraction speed became uneven and accordingly the depressions and cracks were generated in the slabs.

Since No. 18 had a low basicity [T—CaO]/[$SiO_2$] and a large quantity of coarse gehlenite was formed, the heat extraction speed became uneven and accordingly the depressions and cracks were generated in the slabs.

Since the No. 19 was small in the $Li_2O$ amount, the solidification temperature became too high to attain a proper lubricating property and accordingly cracks were generated in the slabs.

Since the No. 20 was in excess in the $Li_2O$ amount, a sufficient amount of $LiAlO_2$ could not be crystallized and the heat extraction speed became uneven and accordingly cracks were generated in the slabs.

Since the No. 21 was large in the C amount and the melting speed was insufficient, portions where the slag film was not formed sufficiently were formed and the portions were quenched to form cracks.

Since the No. 22 was small in the C amount and the melting speed was increased, excess flow and uneven flow were generated and accordingly the depressions and cracks were generated.

Since No. 23 had a low basicity [T—CaO]/[$SiO_2$] and a large quantity of coarse gehlenite was formed, the heat extraction speed became uneven and cracks were generated in the slabs.

Further, $Na_2O$ also existed, an Na—Al—O crystal was unevenly crystallized and it was supposed that it also affected badly on the heat extraction speed.

The invention claimed is:

1. A method of continuous casting a molten steel in a mold using a mold powder while controlling molten steel surface level fluctuation speed, mold oscillation stroke amplitude while pouring the molten steel, and negative strip time tN, wherein the molten steel contains 0.1 to 3.0% (% by mass, hereinafter the same) of Al and also each 4.0% or less (excluding 0%) of Si, Mn, Ni, Cr, and Mo and C in a content [C] satisfying relations defined by the following expressions (1) to (3):

$$f1-0.10 \leqq [C]+0.05 \quad (1);$$

$$f1=0.0828[Si]-0.0195[Mn]+0.07398[Al]-0.04614[Ni]+0.02447[Cr]+0.01851[Mo]+0.090 \quad (2); \text{ and}$$

$$f2=0.2187[Si]-0.03291[Mn]+0.2017[Al]-0.06715[Ni]+0.04776[Cr]+0.04601[Mo]+0.173 \quad (3)$$

wherein [Si], [Mn], [Al], [Ni], [Cr], and [Mo] denote respective contents (% by mass) of Si, Mn, Ni, Cr, and Mo), wherein said mold powder contains T—CaO: 35 to 55%, $SiO_2$: 10 to 30%, $Al_2O_3$: 4.0% or less (excluding 0%), MgO: 0.2 to 1.0%, $Li_2O$: 7 to 13%, F: 7 to 13%, C, 10.5 to 14%, and inevitable impurities and satisfies the following expressions (4) and (5):

$$1.6 \leqq [T—CaO]/[SiO_2] \leqq 5 \quad (4); \text{ and}$$

$$0.2 \leqq [Li_2O]/[SiO_2] \leqq 1.1 \quad (5)$$

wherein [T—CaO], [$SiO_2$], and [$Li_2O$] denote respective contents (% by mass) of T—CaO, $SiO_2$, and $Li_2O$ in the mold powder and T—CaO is the amount of CaO (% by mass) in the mold powder when the total amount of Ca in the mold powder is converted into CaO; and the method is carried out by adjusting the molten steel surface level fluctuation speed in the mold to 14 mm/second or lower; pouring the molten steel in the width direction of the mold using an immersion nozzle at a pouring angle of 0° or more and 55° or less downward from the horizontal direction while applying mold oscillation in the condition of the stroke in the amplitude from greater than 2 mm to no greater than 8 mm and the negative strip time tN defined by the following expression (6) of 0.28 seconds or shorter:

$$tN=(1/\pi f)\cos^{-1}(Vc/\pi f s) \quad (6)$$

wherein f denotes the mold oscillation frequency (Hz); s denotes the distance (mm) between the upper dead point and the lower dead point of the mold at the time of mold oscillation; and Vc denotes the casting velocity (mm/s) of a slab.

2. The method according to claim 1, wherein the operation is carried out while electromagnetic stirring is carried out in the mold at a magnetic flux density of 300 to 1200 gauss.

* * * * *